US012672750B2

(12) United States Patent
Wang et al.

(10) Patent No.: US 12,672,750 B2
(45) Date of Patent: Jul. 7, 2026

(54) METHOD FOR CONTROLLING ROBOT CLEANER, ELECTRONIC DEVICE AND ROBOT CLEANER

(71) Applicant: Beijing Roborock Innovation Technology Co., Ltd., Changping District (CN)

(72) Inventors: Yixing Wang, Changping District (CN); Yansheng Niu, Changping District (CN); Yiming Cong, Changping District (CN); Xinyu Han, Changping District (CN)

(73) Assignee: Beijing Roborock Innovation Technology Co., Ltd., Changping District (CN)

( * ) Notice: Subject to any disclaimer, the term of this patent is extended or adjusted under 35 U.S.C. 154(b) by 73 days.

(21) Appl. No.: 18/574,844

(22) PCT Filed: Aug. 16, 2022

(86) PCT No.: PCT/CN2022/112776
§ 371 (c)(1),
(2) Date: Dec. 28, 2023

(87) PCT Pub. No.: WO2023/020490
PCT Pub. Date: Feb. 23, 2023

(65) Prior Publication Data

US 2025/0089966 A1 Mar. 20, 2025

(30) Foreign Application Priority Data

Aug. 17, 2021 (CN) ..... 202110944064.7

(51) Int. Cl.
*A47L 11/40* (2006.01)
*A47L 11/282* (2006.01)

(52) U.S. Cl.
CPC ..... *A47L 11/4011* (2013.01); *A47L 11/282* (2013.01); *A47L 11/4008* (2013.01);
(Continued)

(58) Field of Classification Search
CPC ..... A47L 11/4011; A47L 11/282; A47L 11/4008; A47L 11/4041; A47L 11/4055;
(Continued)

(56) References Cited

U.S. PATENT DOCUMENTS

2020/0125103 A1* 4/2020 Li ..... A47L 11/24
2021/0034061 A1 2/2021 Yun
(Continued)

FOREIGN PATENT DOCUMENTS

CN 104503450 A 4/2015
CN 106264357 A 1/2017
(Continued)

OTHER PUBLICATIONS

International Search Report and dated Oct. 28, 2022, issued in related International Patent Application No. PCT/CN2022/112776.
(Continued)

*Primary Examiner* — Sharidan Carrillo
(74) *Attorney, Agent, or Firm* — Morgan, Lewis & Bockius LLP

(57) ABSTRACT

Embodiments of the present disclosure disclose a robot cleaner, a method and an apparatus for controlling the robot cleaner, an electronic device, and a storage medium. According to the method, detection information or state information of the robot cleaner is acquired; and the mopping component of the robot cleaner is controlled to stop working and/or to ascend in response that the detection information or the state information satisfies a non-mopping condition.

10 Claims, 5 Drawing Sheets

(52) U.S. Cl.
CPC ..... *A47L 11/4041* (2013.01); *A47L 11/4055* (2013.01); *A47L 11/4061* (2013.01); *A47L 2201/04* (2013.01); *A47L 2201/06* (2013.01)

(58) Field of Classification Search
CPC ..... A47L 11/4061; A47L 2201/04; A47L 2201/06
See application file for complete search history.

(56) References Cited

U.S. PATENT DOCUMENTS

| | | | | |
|---|---|---|---|---|
| 2021/0228050 | A1 | 7/2021 | Zhang et al. | |
| 2025/0089966 | A1* | 3/2025 | Wang | A47L 11/282 |

FOREIGN PATENT DOCUMENTS

| | | | | |
|---|---|---|---|---|
| CN | 207898436 | U | 9/2018 | |
| CN | 109846427 | A | 6/2019 | |
| CN | 110037619 | A | 7/2019 | |
| CN | 110584547 | A | 12/2019 | |
| CN | 110597260 | A | 12/2019 | |
| CN | 110710931 | A | 1/2020 | |
| CN | 110989630 | A | 4/2020 | |
| CN | 111035327 | A | 4/2020 | |
| CN | 111345746 | A | 6/2020 | |
| CN | 111565613 | A | 8/2020 | |
| CN | 213405910 | U | 6/2021 | |
| CN | 213787190 | A | 7/2021 | |
| CN | 114587189 | A | 6/2022 | |
| EP | 3804599 | A1 | 4/2021 | |
| EP | 3900604 | A1 * | 10/2021 | G05D 1/247 |
| EP | 3951544 | A1 * | 2/2022 | G05D 1/246 |
| KR | 10-2005-0063545 | A | 6/2005 | |
| WO | 0182766 | A2 | 11/2001 | |
| WO | 2019233493 | A1 | 12/2019 | |
| WO | 2020/125758 | A9 | 6/2020 | |

OTHER PUBLICATIONS

Office Action dated Dec. 21, 2022, issued in related Chinese Patent Application No. 202110944064.7.
Final Rejection dated Aug. 1, 2023, issued in related Chinese Patent Application No. 202110944064.7.
Extended European Search Report issued in corresponding European Patent Application No. 22857801.9, dated Aug. 12, 2025.

* cited by examiner

METHOD FOR CONTROLLING ROBOT CLEANER, ELECTRONIC DEVICE AND ROBOT CLEANER

CROSS-REFERENCE TO RELATED APPLICATION

This application is the U.S. National Phase Application of PCT International Application No. PCT/CN2022/112776, filed on Aug. 16, 2022, which is based on and claims priority of the Chinese Patent Application No. 202110944064.7 filed on Aug. 17, 2021, and the entire content of both which are incorporated herein by reference.

TECHNICAL FIELD

The present disclosure relates to the field of robot control, in particular to a robot cleaner and a method and an apparatus for controlling the robot cleaner, an electronic device, and a storage medium.

BACKGROUND

In recent years, with the development of social economy and the improvement of living standards of the family, home cleaning has gradually entered an era of intelligence and mechanization, and the emergence of robot cleaners can free people from the home cleaning work, which can effectively reduce the workload of people in the home cleaning and alleviate the degree of fatigue of people in the process of home cleaning.

In addition to sweeping a region to be cleaned, existing robot cleaners can also mop the region to be cleaned, which means that the robot cleaner has both a sweeping mode and a mopping mode. If a cleaning device works in the mopping mode, the robot cleaner may control a piece of mopping cloth at the bottom of the robot cleaner to mop and clean this region.

However, in certain scenarios where the mopping mode is not suitable such as in a carpeted region, a carpet may be soaked by the mopping cloth, which may result in damages to the carpet. However, the existing robot cleaner cannot automatically stop the mopping mode, which may cause the robot cleaner to work with low reliability.

SUMMARY

A series of concepts in simplified form are introduced in this section, and will be described in further detail in the detailed description section. This section of the present disclosure is not indented to limit key features and necessary technical features of the technical solutions as claimed, nor is it intended to attempt to determine the protection scope of the technical solutions as claimed.

In a first aspect, embodiments of the present disclosure provide a method for controlling a robot cleaner, which includes:

acquiring detection information or state information of the robot cleaner in a case that the robot cleaner performs a mopping task; and controlling a mopping component of the robot cleaner to stop working and/or to ascend if the detection information or the state information satisfies a non-mopping condition.

In a second aspect, embodiments of the present disclosure provide an electronic device, including a processor and a memory, wherein the memory is configured to store at least one executable instruction, and the executable instruction causes the processor to implement the steps of any method for controlling the robot cleaner according to the first aspect.

In a third aspect, embodiments of the present disclosure provide a robot cleaner, including a walking component, a mopping component, and a controller, wherein the controller is configured to perform any method for controlling the robot cleaner according to the first aspect.

BRIEF DESCRIPTION OF THE DRAWINGS

The following accompanying drawings of the present disclosure are taken herein as a part of the embodiments of the present disclosure for the purpose of understanding the present disclosure. The accompanying drawings illustrate embodiments of the present disclosure and descriptions thereof for explaining the principles of the present disclosure.

In the drawings.

DETAILED DESCRIPTION

In the following description, a great deal of specific details is given to provide a more thorough understanding of the present disclosure. However, it may be apparent to those skilled in the art that the present disclosure can be implemented without one or more of these details. In other examples, some technical features that are well known in the art will not be described to avoid confusion with the present disclosure.

It shall be noted that the terms used herein are merely intended to describe specific embodiments and are not intended to limit exemplary embodiments according to the present disclosure. As used herein, the singular form is also intended to include the plural form, unless the context clearly indicates otherwise. In addition, it shall also be understood that the terms "comprising" and/or "including" as used in this specification means there exists a feature, an integer, a step, an operation, an element and/or a component, but could not preclude existing or adding of one or more other features, integers, steps, operations, elements, components and/or combinations thereof.

Exemplary embodiments of the present disclosure will be described herein in more detail with reference to the accompanying drawings. However, these exemplary embodiments may be implemented in a variety of different forms and shall not be construed as being limited to the embodiments set forth herein. It shall be understood that these embodiments are provided to make the present disclosure thorough and complete and to fully communicate the ideas of these exemplary embodiments to those of ordinary skill in the art.

A method for controlling a robot cleaner according to the present disclosure may be applied in the robot cleaner. In order to clearly describe the method for controlling the robot cleaner of the present disclosure, the robot cleaner provided according to a third aspect of the present disclosure will be first described in detail below.

As shown in FIGS. 1 to 4, the robot cleaner includes, but is not limited to, a walking component 4, a mopping component, and a controller, the controller being configured to perform the method for controlling the robot cleaner.

In some implementation modes, the robot cleaner further includes a body 1, a sweeping component 3, a sensing component, and other related components. The robot cleaner, which may be a sweeping robot, an intelligent robot, a mobile robot, an automatic sweeper, an intelligent dust collector or the like, is a type of intelligent household appliance that can complete cleaning works such as sweeping, dust absorption and mopping. Specifically, the robot cleaner completes the floor cleaning work in the room by itself according to certain preset rules.

Figure 1:
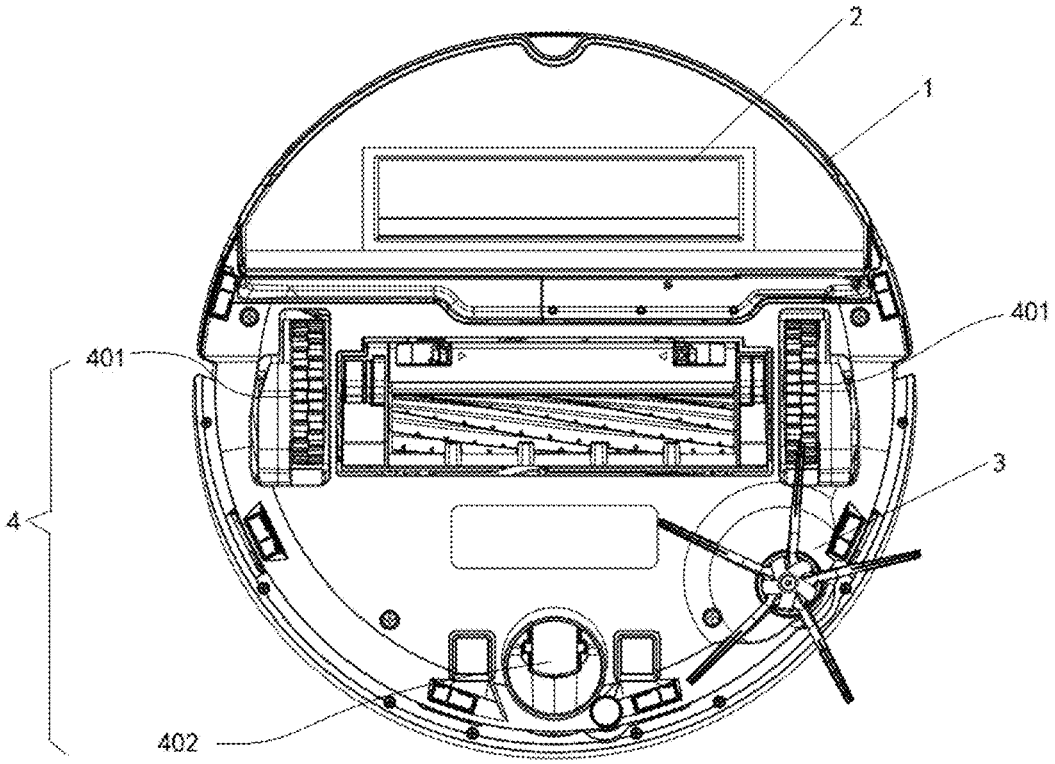
FIG. 1 is a bottom view of a robot cleaner according to an embodiment of the present disclosure.
Figure 2:
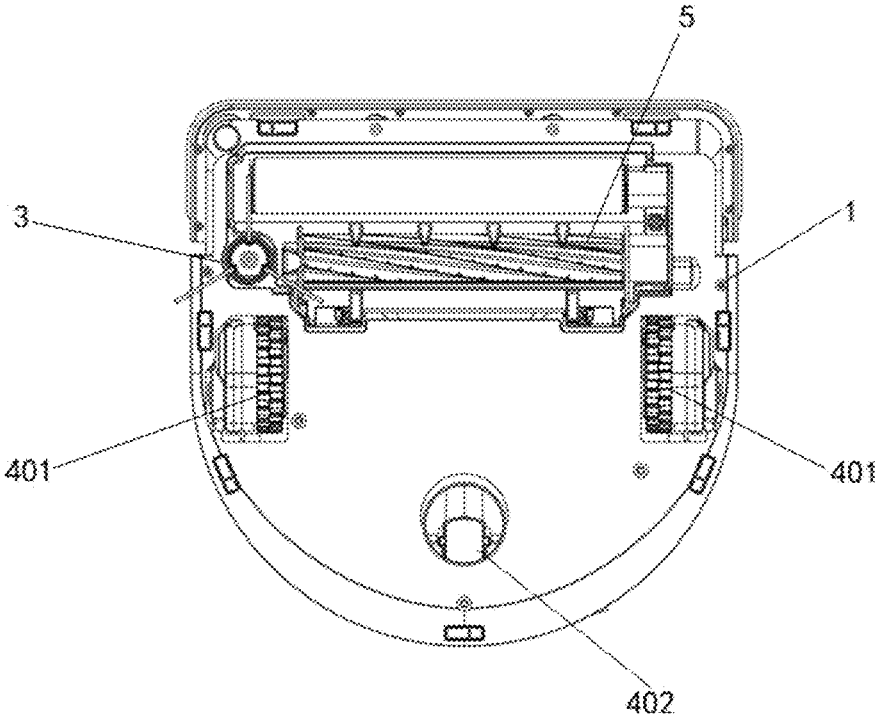
FIG. 2 is a bottom view of a robot cleaner according to another embodiment of the present disclosure.

As shown in FIGS. 1 and 2, the body 1 in the robot cleaner of the present embodiment is of a flat cylindrical structure. A chassis 102 is circular; a top panel of a cover body 101 is circular; side panels of the cover body 101 extend downwardly from the circumferential edge of the circular top panel to form an outer circumferential side wall; and the side panels may also be provided with a plurality of grooves, openings, and the like. When the robot cleaner is moving (the movement includes at least one combination of moving forward, moving backward, steering, and rotating), the body 1 of the flat cylindrical structure has better environmental adaptability. For example, when the robot cleaner moves, the chances of collision with surrounding objects (e.g., furniture and walls) or the strength of collision can be reduced, which thereby reduces the damages to the robot cleaner and the surrounding objects and is more conducive to steering or rotating. However, the body 1 is not limited to this. In other embodiments, the body 1 may also be of, for example, a rectangular body structure, a triangular column structure, or a semi-elliptical column structure (also referred to as a D-shaped structure), and so on.

As shown in FIGS. 1 and 2, the walking component 4 is a component related to the movement of the robot cleaner. The walking component includes driving wheels 401 and universal wheels 402. The universal wheels 402 cooperate with the driving wheels 401 to realize the steering and movement of the robot cleaner. The driving wheels 401 are provided on the left and right sides of the bottom of the robot cleaner, and the universal wheels 402 are provided in a centerline of the bottom surface of the robot cleaner. Each of the driving wheels 401 is provided with a motor for the driving wheels 401, and the driving wheels 401 rotate under the driving of the motor for the driving wheels 401. After the driving wheels 401 rotate, the robot cleaner is driven to move. A steering angle of the robot cleaner can be controlled by controlling a difference in rotation speed of the left and right driving wheels 401.

The robot cleaner is further provided with a spraying component for spraying a cleaning fluid to the mopping component. The spraying component may include a storage tank, a transfer pump, and a jet-flow member. The storage tank is configured to store the cleaning fluid. The storage tank may be, but is not limited to, a regular hexahedral structure (e.g., a rectangular structure, or a prism frustum with a trapezoidal cross-section), a cylindrical structure, or other similar structures, but is not limited thereto. The storage tank may be of other structures depending on the structure of the body 1 and/or the layout design of the chassis 102. The transfer pump is capable of delivering the cleaning fluid in sufficient quantity and in a timely manner to the jet-flow member which in turn sprays the cleaning fluid onto the mopping component.

As shown in FIGS. 1 and 2, the mopping component is configured to mop and clean the region to be cleaned and is provided at the bottom of the body of the robot cleaner. The number of mopping components may be one or more. The mopping component may adopt a structure of a mopping roller brush or a structure of a vibrating mop 2. Specifically, the mopping roller brush includes a mopping roller 6 and a rotating motor capable of driving the rotation of the mopping roller 6. When the robot cleaner carries out the mopping operation, the rotating motor is utilized to drive the rotation of the mopping roller 6 to mop the region to be cleaned. The vibrating mop 2 includes a vibrating motor and a mop 2 connected to the vibrating motor. The vibrating motor is utilized to drive the mop 2 to move back and forth to mop the region to be cleaned during the mopping operation of the robot cleaner. In some implementation modes, the cleaning fluid may be sprayed by the jet-flow member to the mopping roller 6 or the mop 2 before the mopping roller 6 rotates or a piece of mopping cloth vibrates.

Figure 3:
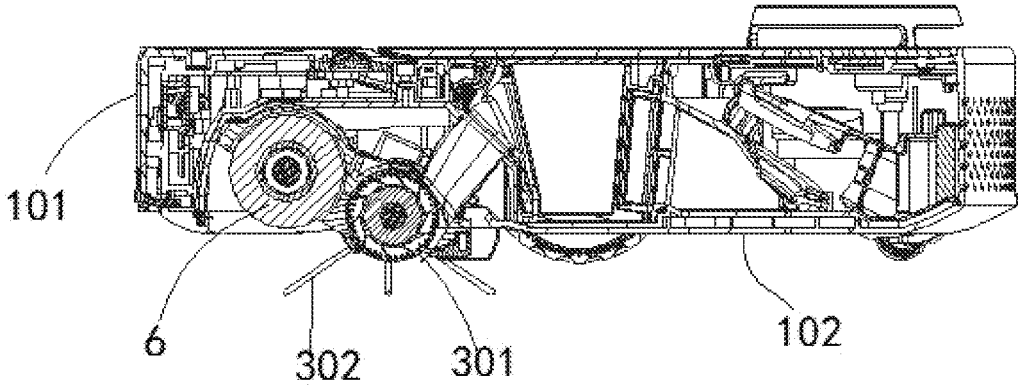
FIG. 3 is a state diagram in which a mopping component ascends and a sweeping component descends according to an embodiment of the present disclosure.

As shown in FIG. 3, the mopping component further includes a lifting and lowering mechanism for controlling the up-down movement of the mopping roller 6 or the mop 2. When the robot cleaner carries out the mopping operation, the mopping roller 6 or the mop 2 is driven to descend by the lifting and lowering mechanism, such that the mopping roller brush or the mopping cloth comes into contact with the region to be cleaned, and then the rotating mopping roller 6 or the vibrating mop 2 carries out the mopping. At the end of the mopping operation or when encountering a region that is not suitable for mopping, such as in a carpeted region or encountering a large obstacle, the mopping roller 6 or the mop 2 is driven to ascend by the lifting and lowering mechanism, thereby preventing the mopping roller 6 or the mop 2 from mopping the region. The lifting and lowering mechanism may adopt an existing structure capable of realizing descending and ascending, which is not strictly limited in this embodiment.

Figure 4:
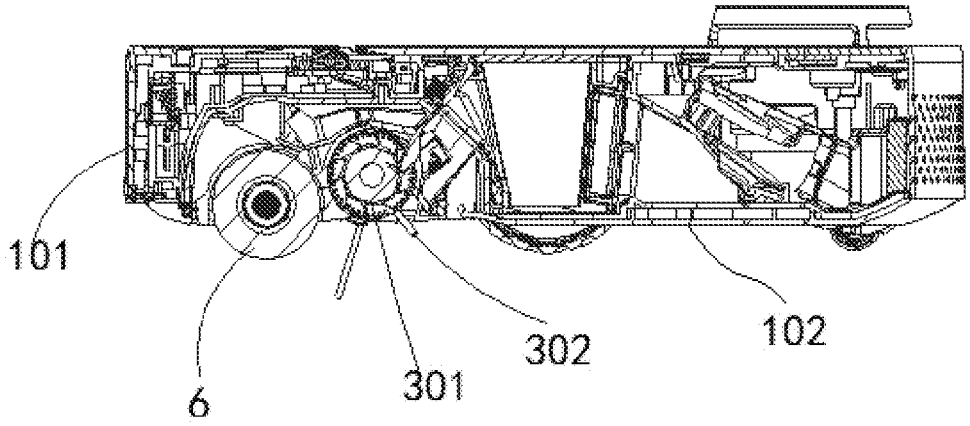
FIG. 4 is a state diagram of a robot cleaner traveling normally according to an embodiment of the present disclosure.

As shown in FIG. 4, the sweeping component 3 may include at least a sweeping roller brush and a dust-absorbing structure. The sweeping roller brush may include a turntable 301, a brush 302 disposed on the turntable 301, and a drive motor for driving the rotation of the turntable 301. A dust-absorbing port is disposed in a lower portion of the body of the robot cleaner. In practice, the drive motor is configured to drive the turntable 301 and brush teeth thereon to rotate for implementing the cleaning work. The dust-absorbing structure may include a dust-collecting box, a dust-absorbing fan and a corresponding channel. The dust-absorbing fan has an air inlet and an air outlet, the air inlet of the dust-absorbing fan being connected to the dust-collecting box via an air inlet channel, the air outlet of the dust-absorbing fan being connected to an air exhaust channel. In practice, a fan motor in the dust-absorbing fan drives the fan to rotate, such that airflow mixed with trash enters the dust-collecting box. The trash in the airflow is filtered by a filter in the dust-collecting box and then stored in the dust-collecting box, and the filtered airflow is discharged from the air outlet of the dust-absorbing fan to the exterior of the robot cleaner via the air exhaust channel.

The sweeping component 3 further includes a lifting and lowering mechanism for controlling the up-down movement of the turntable 301. When the robot cleaner carries out the cleaning operation, the lifting and lowering mechanism drives the turntable 301 to descend, such that the brush 302 comes into contact with the region to be cleaned and is then rotated to implement the cleaning. Then, the dust-absorbing fan absorbs the debris into the dust-collecting box. At the end of the cleaning operation or when encountering a region that is not suitable for cleaning, such as encountering a large obstacle and the like, the lifting and lowering mechanism may drive the turntable 301 to ascend, thereby avoiding the brush 302 from cleaning this region. The lifting and lowering mechanism may adopt an existing structure capable of realizing descending and ascending, which is not strictly limited in this embodiment.

It is understood that the mopping component and the sweeping component 3 cannot be in a descending state at the same time. In other words, when the mopping component is in contact with the surface of the region to be cleaned, the sweeping component 3 cannot be in contact with the surface of the region to be cleaned, which means that the mopping operation and the sweeping operation cannot be carried out at the same time. The mopping component and the sweeping component 3 may both be in an ascending state. In other words, the sweeping component 3 and the mopping component are not in contact with the surface with the region to be cleaned, which means that the robot cleaner performs neither a mopping operation nor a sweeping operation.

The sensing component may include a plurality of sensors of various types for different purposes. The sensors include, but are not limited to, any one or a combination of a ranging sensor 7, a cliff sensor, a fall sensor, a collision detecting sensor, a floor medium detecting sensor, and the like.

The ranging sensor 7 may detect both a pitch angle of the chassis 102 of the robot cleaner relative to the surface of the region to be cleaned and changes in a distance between the robot cleaner and a neighboring object.

Figure 5:
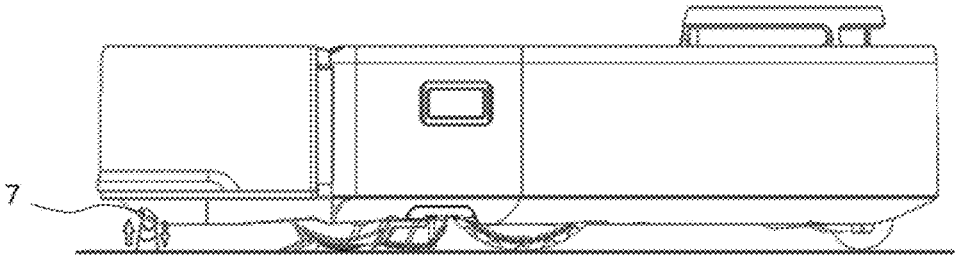
FIGS. 5 and 6 are state diagrams of a robot cleaner crossing an obstacle according to an embodiment of the present disclosure.
Figure 6:
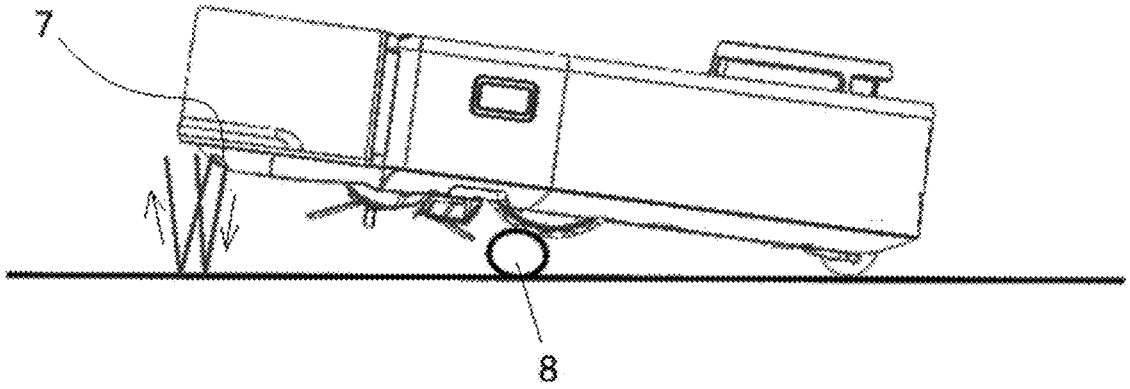

Specifically, in an implementation mode, the ranging sensor 7 may be an infrared ranging sensor 7. The infrared ranging sensor 7 may be disposed at the edge of the chassis 102 of the robot cleaner, and the infrared ranging sensor 7 has an infrared signal emitter and an infrared signal receiver. The infrared signal emitter is utilized to emit a beam of infrared light, which forms a reflection when irradiated to the surface of the region to be cleaned, as shown in FIG. 5. If the reflected infrared light is then received by the infrared signal receiver, it can be determined that the pitch angle of the robot cleaner relative to the surface of the region to be cleaned is zero, which means that the chassis 102 of the robot cleaner is parallel to the surface of the region to be cleaned. As shown in FIG. 6, if the reflected infrared light is not received by the infrared signal receiver, it can be determined that the pitch angle of the robot cleaner relative to the surface of the region to be cleaned is not zero, which means that the chassis 102 of the robot cleaner is not parallel to the surface of the region to be cleaned.

The infrared ranging sensor 7 may also be provided on an anti-collision component of the robot cleaner or on a side wall of the body 1, such that the ranging sensor 7 can detect changes in a distance between the robot cleaner and other objects in a cleaning environment while the robot cleaner is traveling. The infrared ranging sensor 7 has an infrared signal emitter and an infrared signal receiver. The infrared signal emitter is configured to emit a beam of infrared light, which forms a reflection on a surface irradiated to the region to be cleaned, and the distance between the robot cleaner and the object is calculated based on data of a time difference between the emission and reception of the infrared rays.

The ranging sensor 7 according to aforesaid implementation modes may also be a time of flight (ToF) sensor or an ultrasonic ranging sensor 7, the specific sensing principle of which is the same as that of the infrared ranging sensor 7 and will not be repeated.

The collision detecting sensor is provided on the body 1 and associated with a bumper, and mainly includes a light emitter, a light receiver, and a collision telescopic rod located between the light emitter and the light receiver. Under normal conditions, the collision telescopic rod is in an initial position, and a light path between the light emitter and the light receiver is unblocked. When the robot cleaner is unable to dodge and collides with an obstacle, the bumper located at the front of the robot cleaner will be impacted by the obstacle and sink into the body 1. At this point, the collision telescopic rod located inside the bumper is contracted while stressed and blocked between the light emitter and the light receiver, the light path between the light emitter and the light receiver is cut off, and the collision detecting sensor sends out a collision signal.

The cliff sensor is provided at the bottom of the body 1. In some embodiments, there may be a plurality of cliff sensors, such as four cliff sensors, and each of the cliff sensors is provided at a front end of the bottom of the body 1 for transmitting a sensing signal to the floor and sensing a cliff with the signal received by reflection. The cliff sensors are also known as overhang sensors, and are light sensors that primarily utilize a variety of forms. In some embodiments, the cliff sensors may employ infrared sensors each having an infrared signal emitter and an infrared signal receiver. As a result, the cliff can be sensed by emitting infrared light and receiving reflected infrared light, thereby enabling further analysis of the depth of the cliff.

The floor medium detecting sensor may include, but is not limited to, a vision sensor, a laser sensor, an ultrasonic sensor, an infrared sensor, a video camera, a depth camera, or the like. The floor medium detecting sensor is configured to detect the type of a floor medium, and is capable of distinguishing the type of the floor medium and sending the detection results to the controller. Taking a direction in which the robot cleaner is traveling under normal operation as the front, the floor medium detecting sensor is usually provided at the front end or the bottom end of the robot cleaner, so as to be able to promptly be informed of the floor medium at the front or the current position.

Of course, in some embodiments, the sensing device may include other sensors, such as, a magnetometer, an accelerometer, a gyroscope, an odometer, and the like.

The controller is provided on a circuit mainboard within the body 1 and includes a memory (e.g., a hard disk, a flash memory, or a random access memory), a processor (e.g., a central processing unit, or an application processor), and the like. The processor adopts a localization algorithm (e.g., SLAM) to draw an instant map of an environment where the robot cleaner is located according to object information fed back from a laser ranging device in the sensing system, so as to plan the most efficient and reasonable cleaning path and method based on information of the instant map as drawn, thereby greatly improving the cleaning efficiency of the robot. Moreover, combined with the distance information, speed information, attitude information, and the like fed back by other sensors (e.g., a ranging sensor 7, a cliff sensor, a fall sensor, a collision detecting sensor, a magnetometer, an accelerometer, a gyroscope, and an odometer) in a perception system to comprehensively determine what kind of working state a sweeper is currently in, such that a next motion strategy can be specifically given for different situations and corresponding control instructions can be issued to the robot cleaner.

Further, the robot cleaner is also provided with a communication unit for wired or wireless communication with external devices. It may access a wireless network based on a communication standard such as WiFi, 2G or 3G, or a combination thereof. In an exemplary embodiment, the communication unit receives broadcast signals or broadcast-related information from an external broadcast management system via a broadcast channel. In an exemplary embodiment, the communication unit further includes a near field communication (NFC) module to facilitate short-range communication. For example, the NFC module may be implemented based on a radio frequency identification (RFID) technology, an infrared data association (IrDA) technology, an ultra wide band (UWB) technology, a Bluetooth (BT) technology and other technologies.

A power supply apparatus is configured to supply power to other electrical apparatuses. In practical embodiments, the power supply apparatus includes a rechargeable battery (pack), such as a conventional nickel-metal hydride (NiMH) battery which is economical and reliable. Or, the power supply apparatus may adopt other suitable rechargeable batteries (packs), such as lithium batteries, which have a higher size-to-energy ratio than NiMH batteries, do not have a memory effect, and can be recharged as needed with a much higher degree of convenience. The rechargeable battery (pack) is mounted in a battery recess of the chassis 102, and the battery recess may be customized in size according to the battery (pack) being mounted. The rechargeable battery (pack) may be mounted in the battery recess by conventional means, such as a spring latch. The battery recess may be closed by a battery cover plate which may be secured to the chassis 102 by conventional means, such as screws. The rechargeable battery (pack) may be connected with a charging control circuit, a battery charging temperature detecting circuit and a battery undervoltage monitoring circuit. The charging control circuit, the battery charging temperature detecting circuit and the battery undervoltage monitoring circuit are then connected to a control system. The robot cleaner is charged by connecting a charging electrode provided at the side or bottom of the body 1 to a charging seat.

Figure 7:
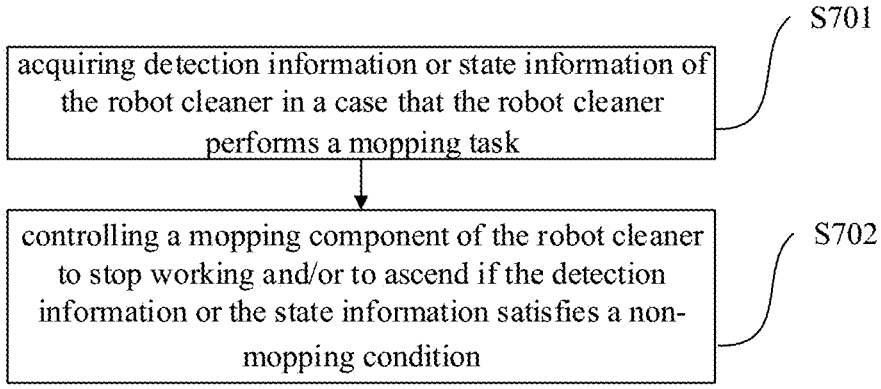
FIG. 7 is a flowchart of a method for controlling a robot cleaner according to an embodiment of the present disclosure.

The following is a detailed description of a method for controlling a robot cleaner according to a first aspect of the present disclosure. As shown in FIG. 7, an embodiment of the present disclosure provides a method for controlling a robot cleaner, which includes following steps.

In S701, detection information or state information of the robot cleaner is acquired in a case that the robot cleaner performs a mopping task.

When the robot cleaner performs the mopping task, that is, when the robot cleaner enters a working state of mopping, a controller controls a lifting and lowering mechanism of a mopping component to drive a mopping roller 6 or a mop 2 to descend to a position that is in contact with the surface to be cleaned; and then the mopping roller 6 is driven to rotate by a rotating motor or the mop 2 is driven to vibrate by a vibrating motor to mop a region to be cleaned.

The detection information of the robot cleaner herein includes, but is not limited to, information on obstacles detected by the robot cleaner, current travel path information, floor medium information, and information on a positional attitude (e.g., a pitch angle of the robot cleaner relative to the surface of the region to be cleaned). The detection information of the robot cleaner may be detected and acquired by the sensing component of the robot cleaner according to the aforesaid embodiment.

The state information of the robot cleaner includes, but is not limited to, a traveling mode of the robot cleaner, the traveling mode including, but not limited to, a normal traveling mode and a de-trapping mode. The de-trapping mode refers to a mode that enables the robot cleaner to escape from a trapped state when the robot cleaner is trapped. The controller enables the robot cleaner to switch between the normal traveling mode and the de-trapping mode based on a preset condition, thereby allowing the robot cleaner to travel normally without being trapped.

Due to the complexity of a working environment of the robot cleaner, the robot cleaner may be trapped in some regions, and whether the robot cleaner is trapped can be determined by following judgment conditions, i.e., to detect a duration for which the robot cleaner stays in the same region, and it can be determined that the robot cleaner is trapped if the duration exceeds a preset duration. The preset duration herein may be 10 minutes, and the judgment condition may effectively avoid wasting time and power due to the robot cleaner being trapped in the region for a long time. After determining that the robot cleaner is successfully de-trapped, the robot cleaner may be switched to the normal traveling mode.

In S702, the mopping component of the robot cleaner is controlled to stop working and/or to ascend if the detection information or the state information satisfies a non-mopping condition.

The non-mopping condition can be set by a manufacturer before the robot cleaner leaves the factory or be set by the user, which is not strictly limited in this embodiment.

In a case that the detection information or the state information satisfies the non-mopping condition, the mopping component of the robot cleaner is controlled to stop working and/or to ascend. Thus, the method can automatically stop the mopping mode in certain scenarios where the mopping mode is not appropriate, such that the working reliability of the robot cleaner can be improved.

Due to the complexity of the working environment of the robot cleaner, the robot cleaner may encounter different situations during the cleaning operation. The method for controlling the robot cleaner will be described in detail below for different cases.

The first case is that the detection information of the robot cleaner includes a pitch angle of the robot cleaner relative to the surface of the region to be cleaned. In this embodiment, there is no need to detect the specific pitch angle, and what is needed is to detect whether the pitch angle of the robot cleaner relative to the surface of the region to be cleaned is zero by the ranging sensor 7 provided at the edge of the chassis 102. The ranging sensor 7 may be an infrared ranging sensor 7, an ultrasonic ranging sensor 7 or a ToF sensor. Exemplarily, the ranging sensor 7 is an infrared ranging sensor 7, and the infrared ranging sensor 7 has an infrared signal emitter and an infrared signal receiver. The infrared signal emitter is utilized to emit a beam of infrared light, which forms a reflection when irradiated to the surface of the region to be cleaned, as shown in FIG. 5. If the reflected infrared light is then received by the infrared signal receiver, it can be determined that the pitch angle of the robot cleaner relative to the surface of the region to be cleaned is zero, which means that the chassis 102 of the robot cleaner is parallel to the surface of the region to be cleaned. As shown in FIG. 6, if the reflected infrared light is not received by the infrared signal receiver, it can be determined that the pitch angle of the robot cleaner relative to the surface of the region to be cleaned is not zero, which means that the chassis 102 of the robot cleaner is not parallel to the surface of the region to be cleaned. Of course, the pitch angle of the robot cleaner relative to the surface of the region to be cleaned may also be detected by the cliff sensor and the floor medium detecting sensor according to the aforesaid embodiment.

The step S702 according to the aforesaid embodiment specifically includes:

controlling the mopping component to stop working or controlling the mopping component to stop working and to ascend if the pitch angle is not zero.

When the robot cleaner performs a mopping operation, if the pitch angle is not zero, which indicates that the chassis 102 of the robot cleaner is not parallel to the surface of the region to be cleaned, it may happen that the robot cleaner travels from a hard floor to a carpet or the robot cleaner passes an obstacle 8 such as a threshold. At this point, the controller controls the mopping component to stop working and namely controls the rotating motor of the mopping component to stop rotating or the vibrating motor to stop vibrating.

Further, in order to avoid the mopping component from wetting the carpet, or avoid the obstacle 8 from scratching the mopping component and causing a cleaning fluid on the mopping component to drip or damaging the mopping component, the controller controls the mopping component to stop working and to ascend. Specifically, the controller controls the rotating motor of the mopping component to stop rotating or the vibrating motor to stop vibrating, and drives the mopping roller 6 or the mop 2 to ascend by the lifting and lowering mechanism of the mopping component, thereby avoiding the carpet or the obstacle.

The second case is that the detection information of the robot cleaner includes obstacle information detected by the robot cleaner, the obstacle information includes a distance between the robot cleaner and the obstacle.

In this embodiment, the obstacle is a stain or a particle having a certain size. The distance between the robot cleaner and the obstacle may be detected by the ranging sensor 7 on an anti-collision component or a side wall of a body 1 according to the aforesaid embodiment. The ranging sensor 7 may be an infrared ranging sensor 7, an ultrasonic ranging sensor 7 or a ToF sensor. Exemplarily, the ranging sensor 7 is an infrared ranging sensor 7, and the infrared ranging sensor 7 has an infrared signal emitter and an infrared signal receiver. The infrared signal emitter is configured to emit a beam of infrared light, which forms a reflection on a surface irradiated to the region to be cleaned, and a distance between the robot cleaner and an object is calculated based on data of a time difference between the emission and reception of the infrared rays.

The S702 according to the aforesaid embodiment specifically includes:

controlling the mopping component to ascend if the distance between the robot cleaner and the obstacle is less than or equal to a first preset distance.

The first preset distance may be set before the robot cleaner is shipped from the factory. When the robot cleaner carries out the mopping operation, if the distance between the robot cleaner and the obstacle is less than or equal to the first preset distance, that is, if the robot cleaner is closer to the obstacle, the mopping component is controlled to ascend, such that situations where the mopping component is unable to clean the obstacle or the obstacle is too large and causes an interference with the mopping component can be avoided from affecting the mopping operation.

In specific applications, after the mopping component ascends, the robot cleaner adopts different strategies for different sizes of the obstacles, which will be described in detail below.

Specifically, the obstacle information further includes a size of the obstacle.

The size of the obstacle is acquired from images captured by a camera provided on the robot cleaner. Specifically, during the movement, the camera may continuously capture images of an environment in the field of view of the robot cleaner. The robot cleaner may analyze the environment images using its own preset image analysis algorithm to determine the size information of the obstacle.

In another mode, the size of the obstacle is acquired by a laser sensor provided on the robot cleaner, and the laser sensor may specifically include an emitter and a receiver. In some embodiments, the receiver may be a depth camera or a CCD camera. The emitter continuously emits laser signals during the movement of the robot. When the laser signal emitted by the emitter irradiates an obstacle, the receiver may capture an image as acquired after the laser irradiation. Then, point cloud data corresponding to the obstacle is determined based on the acquired image, the point cloud data including coordinate information of points on the surface of the obstacle object in a three-dimensional space. Based on the point cloud information, a contour of the obstacle can be outlined, which means that the size information of the obstacle can be determined.

In some embodiments, a laser emitted by the laser sensor described above may be a line laser or a surface laser. Meanwhile, the size information may include a height and/or a width of the obstacle depending on the actual needs. It should be noted that when the size information only includes the height of the obstacle, the robot cleaner simply walks along a straight line and determines the height of the obstacle in accordance with either of aforesaid two modes. When the size information includes the width of the obstacle, the robot cleaner is required to continuously rotate left and right in a small extent while walking along a straight line, such that the laser sensor can acquire data within a wider field of view for calculating the width of the obstacle.

Figure 8:
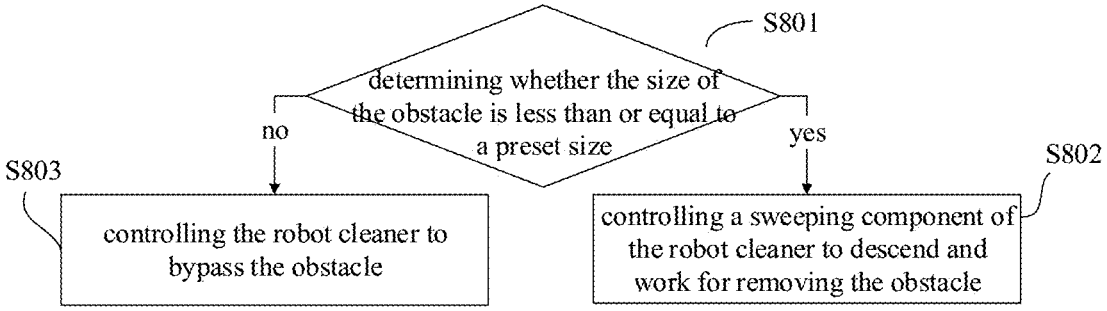
FIG. 8 is a flowchart after controlling a mopping component of a robot cleaner to stop ascending according to an embodiment of the present disclosure.

As shown in FIG. 8, after controlling the mopping component of the robot cleaner to stop ascending, the method specifically further includes following steps.

In S801, whether the size of the obstacle is smaller than or equal to a preset size is determined; if so, S802 is performed; and if not, S803 is performed.

The preset size may be designed according to the cleaning ability of the robot cleaner. If the robot cleaner has a strong cleaning ability, the preset size may be set rather large; and if the robot cleaner has a weak cleaning ability, the preset size may be set relatively small.

In S802, the sweeping component 3 of the robot cleaner is controlled to descend and work for removing the obstacle.

In a case that the size of the obstacle is smaller than or equal to the preset size, the controller controls the lifting and lowering mechanism of the sweeping component 3 to drive the turntable 301 to descend, such that the brush 302 is brought into contact with the surface of the region to be cleaned; then, a drive motor drives the turntable 301 to rotate to sweep the obstacle to a dust-absorbing port; and the dust-absorbing fan absorbs the debris into a dust-collecting box to remove the obstacle, such that a cleaning effect can be improved.

Exemplarily, it is assumed that the size of the obstacle is 0.5 cm in height and 0.2 cm in width, and the preset size is 1 cm in height and 1 cm in width. In this case, the size of the obstacle is smaller than the preset size, the controller controls the lifting and lowering mechanism of the sweeping component 3 to drive the turntable 301 to descend, such that the brush 302 is brought into contact with the surface of the region to be cleaned. Then, the drive motor drives the turntable 301 to rotate to sweep the obstacle to the dust-absorbing port, and the dust-absorbing fan absorbs the debris into the dust-collecting box.

In S803, the robot cleaner is controlled to bypass the obstacle.

If the size of the obstacle is greater than the preset size, it indicates that the size of the obstacle has exceeded the cleaning ability of the sweeping component 3 and the obstacle-crossing ability of the robot cleaner. Thus, if the robot cleaner forcibly crosses the obstacle, the robot cleaner may have difficulty in crossing the obstacle, or even be stuck in the obstacle. Therefore, at this time, it shall be determined that the robot cleaner needs to avoid this obstacle, such that the aforesaid obstacle-crossing difficulty and stuck situations can be avoided, and the robot cleaner can pass through the obstacle smoothly and complete the task successfully. A motion path to avoid obstacles can be acquired by a path planning algorithm configured for the robot cleaner. When planning the path, an algorithm may also take into account the width of the obstacle to ensure that the planned motion path has the best obstacle avoidance effect, which can avoid the obstacle and achieves a shortest motion path.

Exemplarily, it is assumed that the size of the obstacle is 5 cm in height and 5 cm in width, and the preset size is 1 cm in height and 1 cm in width. In this case, the size of the obstacle is greater than the preset size, and the controller controls the robot cleaner to bypass the obstacle.

Figure 9:
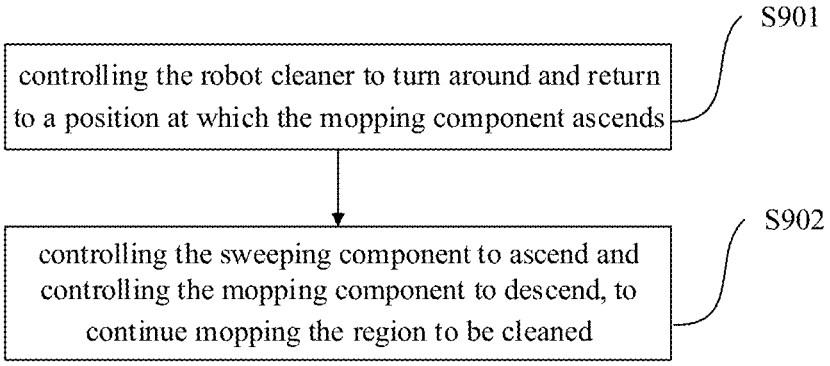
FIG. 9 is a flowchart after S802.

In order to fully clean the region to be cleaned, as shown in FIG. 9, the method, after S802 according to the aforesaid embodiment, further includes following steps.

In S901, the robot cleaner is controlled to turn around and return to a position at which the mopping component ascends.

After a sweeping member removes the obstacle, the robot cleaner returns to the position at which the mopping component ascends, such that the robot cleaner is able to re-mop a region that was not mopped to ensure that the region to be cleaned is fully mopped, thereby improving the cleaning effect.

In S902, the sweeping component 3 is controlled to ascend, and the mopping component is controlled to descend to continue mopping the region to be cleaned.

After the robot cleaner returns to the position at which the mopping component ascends, the controller controls the sweeping component 3 to ascend and controls the mopping component to descend, thereby re-mopping the region that was not mopped due to the obstruction of the obstacle.

In a case that the obstacle is large and avoided, the method, after S803 according to the aforesaid embodiment, further includes: controlling the mopping component to descend to continue mopping the region to be cleaned.

After the robot cleaner bypasses the obstacle, the controller controls the mopping component to descend to continue the mopping operation in the region to be cleaned, so as to complete the mopping task.

The third case is that the detection information of the robot cleaner includes current travel path information of the robot cleaner.

A real-time position of the robot cleaner can be determined by utilizing various types of sensors of the sensing component according to the aforesaid embodiment, and the current travel path information of the robot cleaner can be acquired by changes in the real-time position of the robot cleaner.

The S702 according to the aforesaid embodiment specifically includes:

controlling the mopping component of the robot cleaner to ascend if the current travel path information indicates that the robot cleaner enters from a sub-region to be cleaned into another sub-region to be cleaned, where the region to be cleaned includes a number of sub-regions to be cleaned.

The region to be cleaned may be any one of the regions to be cleaned, such as a home space, a room unit of a home space, a portion of a room unit, a large-scale place, or a portion of a large-scale place.

In a possible implementation mode, prior to the present step, the robot cleaner may acquire a map for representing the region to be cleaned and store the region map; and the robot cleaner may directly acquire the stored region map when performing the present step. The robot cleaner may store the region map to the memory.

The robot cleaner acquires the map of the region to be cleaned in the following four implementation modes. For the first implementation mode, the robot cleaner may detect the region to be cleaned by one or more of a LiDAR, an inertial measurement unit, a collision sensor, and a vision sensor mounted on the robot cleaner, and acquire a map of the region to be cleaned.

For the second implementation mode, the robot cleaner cleans an edge of the region to be cleaned, such that the map of the region to be cleaned can be acquired based on a cleaning trajectory of the edge portion.

For the third implementation mode, a region map is stored in a server, and the robot cleaner acquires the region map from the server. Specifically, the robot cleaner sends an acquisition request to the server that carries a region identification of the region to be cleaned; the server receives the acquisition request, acquires a map of the region to be cleaned based on the region identification, and sends the region map to the robot cleaner; and the robot cleaner receives the region map. The region identification may be an address of the region to be cleaned, and the like.

For the fourth implementation mode, the user directly inputs the region map of the region to be cleaned to the robot cleaner via a terminal. The robot cleaner receives the map of the region to be cleaned as inputted by the terminal.

It is to be understood that the robot cleaner may acquire the region map of the region to be cleaned by any one of the four implementation modes. The robot cleaner may also acquire the map of the region to be cleaned by more than one of the four implementation modes, acquire a plurality of region maps, and then integrate and correct the acquired plurality of region maps to finally determine the map of the region to be cleaned.

In this embodiment, the region to be cleaned is divided into a plurality of sub-regions to be cleaned, and the robot cleaner traverses each of the sub-regions to be cleaned in accordance with a preset cleaning order to clean each of the sub-regions to be cleaned.

Specifically, during the process of the robot cleaner performing a mopping operation on each sub-region to be cleaned one by one, the robot cleaner is required to move from one cleaning sub-region to other cleaning sub-regions. For example, in a case that the robot cleaner needs to return to a charging post to recharge, or needs to go to a specified location to clean the mopping component, the robot cleaner needs to travel from the current mopping location to the charging post or the location where the mopping component is being cleaned. Whereas, the charging post may be located outside the sub-region to be cleaned that the robot cleaner is currently mopping. Thus, the robot cleaner needs to move out of the currently mopped sub-region to be cleaned and get to the charging post or the cleaning-mopping component after passing through one or more sub-regions to be cleaned, where the sub-region to be cleaned as passed by the robot cleaner may be a mopped region or a non-mopped region. In another example, after cleaning the current sub-region to be cleaned, the robot cleaner needs to move to the next sub-region to be cleaned. Of course, in addition to the aforesaid situation, there are other cases where the robot cleaner is required to move from one sub-region to be cleaned to another sub-region to be cleaned, which will not be enumerated in this embodiment.

In this embodiment, in a case that the robot cleaner moves from one sub-region to be cleaned into another sub-region to be cleaned, the controller controls the mopping component of the robot cleaner to ascend, thereby avoiding the mopping component from affecting the cleanliness of the other sub-regions to be cleaned.

The fourth case is that the mopping component includes a mopping roller brush, and the detection information of the robot cleaner includes floor medium information detected by the robot cleaner.

For the floor medium information, a vision sensor may capture images of a floor medium in a forward direction of the robot cleaner, and images of the floor medium can be processed according to a preset recognition algorithm and features of a floor medium model, so as to acquire relevant parameters accustomed to the floor medium, i.e., the floor medium information. In another embodiment, the floor medium information in the forward direction of the robot cleaner is detected by an ultrasonic sensor provided at the bottom of the body 1.

Figure 10:
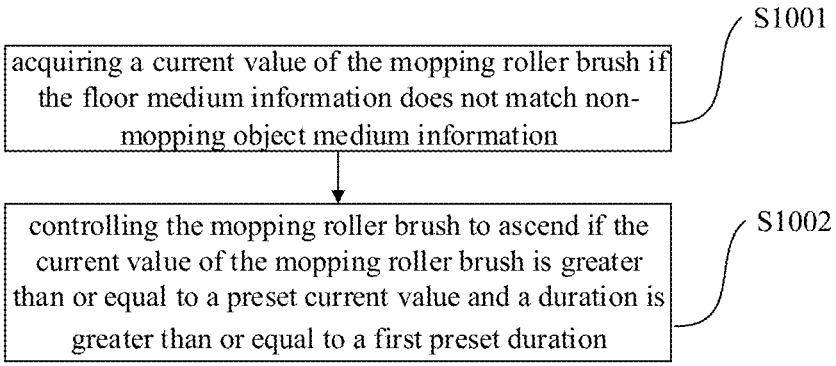
FIG. 10 is a flowchart of S702.

As shown in FIG. 10, S702 according to the aforesaid embodiment specifically includes following steps.

In S1001, a current value of the mopping roller brush is acquired if the floor medium information does not match non-mopping object medium information.

In specific applications, during the process of the robot cleaner traveling from a hard floor to a non-mopping object, it may happen that a part of the robot cleaner is already on the non-mopping object, and the other part of the robot cleaner is still on the hard floor. In such a case, the floor medium detecting sensor may not detect the non-mopping object. Thus, if the robot cleaner is judged to be on the non-mopping object (e.g., a carpet) only based on a detection result of the floor medium detecting sensor, it may happen that the mopping component comes into contact with the carpet and causes the non-mopping object to be wetted. In order to avoid aforesaid problems, in this implementation mode, whether the robot cleaner is partially on the carpet is determined based both on the detection result of the floor medium detecting sensor and the current monitoring of the mopping roller brush, such that the accuracy of the control can be improved.

In this embodiment, if the floor medium information detected by the floor medium sensor does not match the non-mopping object medium information, it means that the robot cleaner as a whole is not on the non-mopping object, or that the robot cleaner is partially already on the non-mopping object. Thus, in order to further determine a state that the robot cleaner is in, it is necessary to further verify the current value of the mopping roller brush.

In S1002, the mopping roller brush is controlled to ascend if the current value of the mopping roller brush is greater than or equal to a preset current value and a duration is greater than or equal to a first preset duration.

When an external force on the mopping roller brush increases, the current value of the mopping roller brush increases; and when the external force on the mopping roller brush decreases, the current value of the mopping roller brush decreases. As a result, in a case that the floor medium information detected by the floor medium sensor does not match the floor medium information, whether the robot cleaner is partially on the non-mopping object can be preliminarily determined by monitoring the current value of the mopping roller brush. Thus, it is necessary to control the mopping roller brush to ascend to avoid drenching the non-mopping object.

Exemplarily, it is assumed that the current value of the mopping roller brush is 5 A, the preset current value is 3 A, the duration for which the current value of the mopping roller brush is 5 A is 15 seconds, and the first preset duration is 10 seconds. Under this case, the controller controls the mopping roller brush to ascend.

In specific applications, in a case that the mopping roller brush is entangled by thread-like debris (such as hair), the current value of the mopping roller brush also increases and may last for a long time. Thus, in order to accurately determine whether or not the robot cleaner is partially on the non-mopping object, the current value after the mopping roller brush ascends shall be further monitored.

Figure 11:
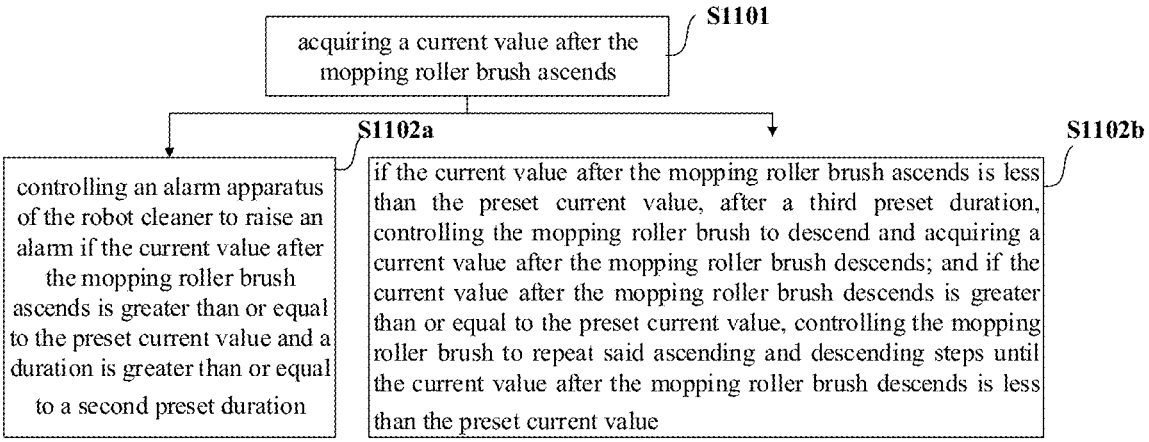
FIG. 11 is a flowchart after S1002.

Specifically, as shown in FIG. 11, the method, after S1002 according to the aforesaid embodiment, further includes the following steps.

In S1101, a current value after the mopping roller brush ascends is acquired.

In S1102*a*, an alarm device of the robot cleaner is controlled to raise an alarm if the current value after the mopping roller brush ascends is greater than or equal to a preset current value and the duration is greater than or equal to a second preset duration.

After the mopping roller brush ascends, it means that the mopping roller brush is no longer in contact with the surface of the region to be cleaned; and if the current value of the mopping roller brush is still large and lasts for a long period of time, it means that the external force of the mopping roller brush is not a friction force with the non-mopping object. Thus, it can be determined that the mopping roller brush is entangled by the thread-like debris and subject to a large amount of resistance, such that the controller can control the alarm device to raise an alarm to remind the user to clean the mopping roller brush.

Exemplarily, it is assumed that the current value after the mopping roller brush ascends is 5 A, the preset current value is 3 A, the duration for which the current value of the mopping roller brush is 5 A is 8 seconds, and the second preset duration is 5 seconds. Under this case, the controller controls the alarm device to raise an alarm.

Specifically, the alarm may be in a form of an alarm light, an alarm sound, or both an alarm light and an alarm sound. The alarm light may be a constant light, a flashing light, or the like; and the alarm sound may be a long alarm, an intermittent alarm, or the like.

In S1102*b*, the mopping roller brush is controlled to descend after a third preset duration and the current value after the mopping roller brush descends is acquired if the current value after the mopping roller brush ascends is less than the preset current value; and the mopping roller brush is controlled to repeat said ascending and descending steps until the current value after the mopping roller brush descends is less than the preset current value if the current value after the mopping roller brush descends is greater than or equal to the preset current value.

After the mopping roller brush ascends, if the current value after the mopping roller brush ascends is less than the preset current value, it means that the external force on the mopping roller brush disappears, which also indicates that the friction force between the non-mopping object and the mopping roller brush disappears, such that it can be determined that the robot cleaner is partially located on the non-mopping object.

In order to automatically continue the mopping operation after the robot cleaner drives out of the region where the non-mopping object is located, in this embodiment, the controller controls the mopping roller brush to descend after the mopping roller brush ascends for the third preset duration, such that the mopping roller brush is in contact with the surface of the region to be cleaned, and the current value after the mopping roller brush descends is monitored. If the current value after the mopping roller brush descends is less than the preset current value, it indicates that the mopping roller brush does not receive a large external force, which also means that the robot cleaner is not on the non-mopping object, so that the controller no longer controls the mopping roller brush to ascend to enable the robot cleaner to continue the mopping operation. If the current value after the mopping roller brush descends is greater than or equal to the preset current value, it means that the mopping roller brush is subjected to a large friction force, which means that the robot cleaner is at least partially located on the non-mopping object. At this point, the mopping roller brush shall be further controlled to ascend in order to avoid drenching the non-mopping object. Then, after the mopping roller brush ascends for the third preset duration, the mopping roller brush is controlled to descend, such that the mopping roller brush is in contact with the surface of the region to be cleaned, and the current value after the mopping roller brush descends is monitored. If the current value after the mopping roller brush descends is still greater than or equal to the preset current value, the robot cleaner is at least partially still located on the non-mopping object. Thus, the aforesaid process of controlling the ascending and descending of the mopping roller brush is further required, and the controller no longer controls the mopping roller brush to ascend until the current value after the mopping roller brush descends is less than the preset current value, so as to enable the robot cleaner to continue the mopping operation.

Exemplarily, it is assumed that the current value after the mopping roller brush ascends is 2 A, the preset current value is 3 A, and the third preset duration is 5 seconds. In this case, after 5 seconds, the controller controls the mopping roller brush to descend for the first time; and if the current value of the mopping roller brush after the first descending of the mopping roller brush is 2 A, the mopping roller brush may no longer ascend. If the current value after the first descending of the mopping roller brush is 5 A, the controller controls the mopping roller brush to ascend and then to descend after 5 seconds. If the current value after the second descending of the mopping roller brush is still 5 A, the controller controls the mopping roller brush to ascend and then to descend again after 5 seconds. If the current value after the third descending of the mopping roller brush is 2 A, the mopping roller brush will not ascend again.

In this embodiment, the robot cleaner is able to accurately identify whether the mopping component is entangled with debris or whether the robot cleaner is on top of a non-mopping object by detecting the current of the mopping roller brush that ascends. Further, the robot cleaner is also able to determine that the robot cleaner is driving out of the region where the non-mopping object is located by detecting the current of the mopping roller brush that descends, and to continue the mopping operation after determining that the robot cleaner is driving out of the region where the non-mopping object is located, thereby increasing the degree of automation of the robot cleaner.

The fifth case is that the state information of the robot cleaner includes a current traveling mode of the robot cleaner.

The state information of the robot cleaner includes, but is not limited to, a traveling mode of the robot cleaner, the traveling mode including, but not limited to, a normal traveling mode and a de-trapping mode. The controller causes the robot cleaner to switch between the normal traveling mode and the de-trapping mode based on a preset condition, so as to enable the robot cleaner to travel normally without being trapped.

The S702 in the aforesaid embodiments specifically includes: controlling the mopping component to ascend if the traveling mode is the de-trapping mode.

Due to the complexity of the working environment of the robot cleaner, the robot cleaner may be trapped in some regions, and whether the robot cleaner is trapped can be determined by the following judgment condition, i.e., to detect a duration for which the robot cleaner is in the same region; and if this duration exceeds a preset duration, it can be determined that the robot cleaner is trapped. The preset duration herein may be 10 minutes, and the judgment condition may effectively avoid wasting time and power due to the robot cleaner being trapped in this region for a long time.

When the robot cleaner enters the de-trapping mode, it is indicated that the robot cleaner is trapped, and the controller at this point controls the mopping component to ascend, such that the mopping component can be prevented from mopping the same region for a long period of time, thereby avoiding the accumulation of water in this region and avoiding reducing the cleaning effect. In addition, the mopping component is also prevented from interfering with the de-trapping motion, which improves the efficiency of the de-trapping.

Figure 12:
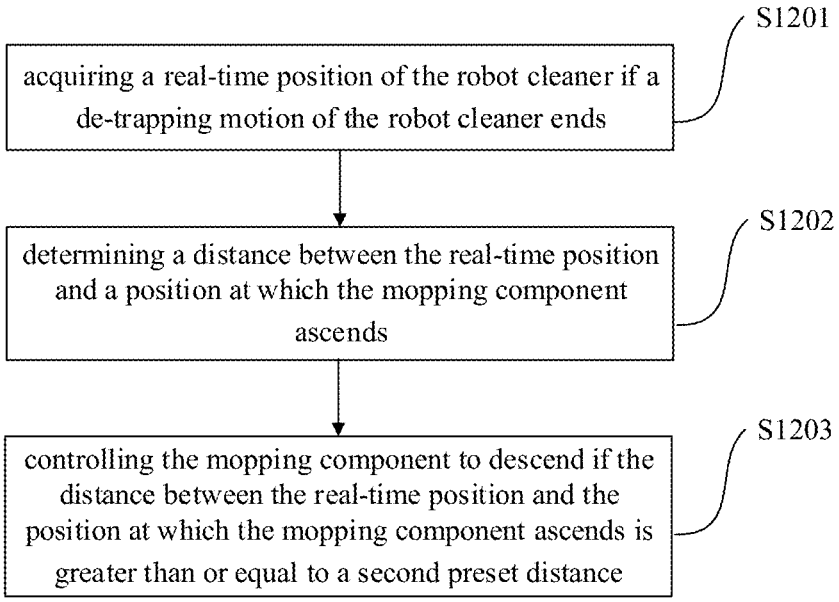
FIG. 12 is a flowchart after controlling a mopping component of a robot cleaner to ascend according to another embodiment of the present disclosure.

Further, as shown in FIG. 12, the method, after controlling the mopping component of the robot cleaner to ascend, further includes the following steps.

In S1201, a real-time position of the robot cleaner is acquired if a de-trapping motion of the robot cleaner ends.

After determining that the robot cleaner has successfully de-trapped, the robot cleaner switches to the normal traveling mode and acquires the real-time position of the robot cleaner.

In S1202, a distance between the real-time position and a position at which the mopping component ascends is determined.

In S1203, the mopping component is controlled to descend if the distance between the real-time position and the position at which the mopping component ascends is greater than or equal to a second preset distance.

The position at which the mopping component ascends is also a position at which the robot cleaner is trapped. After the robot cleaner is de-trapped, and in a case that there exists a certain distance between the real-time position of the robot cleaner and the position at which the mopping component ascends, the mopping component is controlled to descend to continue the mopping operation, thereby increasing the degree of automation of the robot cleaner.

Figure 13:
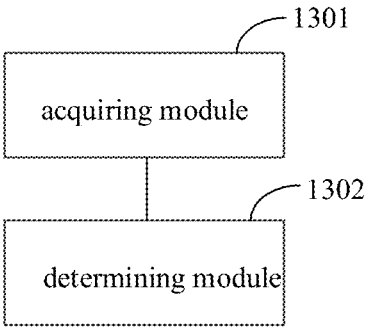
FIG. 13 is a structural diagram of a control apparatus for a robot cleaner according to an embodiment of the present disclosure.

In a second aspect, as shown in FIG. 13, embodiments of the present disclosure provide a control apparatus for a robot cleaner, the control apparatus including:

an acquiring module 1301, configured to acquire detection information or state information of the robot cleaner in a case that the robot cleaner performs a mopping task; and a determining module 1302, configured to control a mopping component of the robot cleaner to stop working and/or to ascend if the detection information or the state information satisfies a non-mopping condition.

In a fourth aspect, embodiments of the present disclosure provide an electronic device, which includes a processor and a memory. The memory is configured to store at least one executable instruction, the executable instruction causing the processor to implement the steps of any method for controlling the robot cleaner according to the first aspect.

The processor may be a central processing unit CPU, or an application specific integrated circuit (ASIC), or one or more integrated circuits configured to implement embodiments of the present disclosure. The one or more processors included in the computer device may be of the same type of processor, such as one or more CPUs, or may be of different types of processors, such as one or more CPUs and one or more ASICs.

The memory is configured to store programs. The memory may include a high-speed RAM memory or may also include a non-volatile memory, such as at least one disk memory.

A computer-readable storage medium may be a ROM, a random access memory (RAM), a CD-ROM, a magnetic tape, a floppy disk, an optical data storage device or the like.

In a fifth aspect, embodiments of the present disclosure provide a computer-readable storage medium that stores computer program instructions therein. The computer program instructions, when invoked and executed by the processor, implement the steps of any method for controlling the robot cleaner according to the first aspect.

In a first aspect, embodiments of the present disclosure provide a method for controlling a robot cleaner, which includes:

acquiring detection information or state information of the robot cleaner in a case that the robot cleaner performs a mopping task; and controlling a mopping component of the robot cleaner to stop working and/or to ascend if the detection information or the state information satisfies a non-mopping condition.

In some possible implementation modes, the detection information of the robot cleaner includes a pitch angle of the robot cleaner relative to a surface of a region to be cleaned; and controlling the mopping component of the robot cleaner to stop working and/or to ascend if the detection information satisfies the non-mopping condition includes:

if the pitch angle is not zero, controlling the mopping component to stop working or controlling the mopping component to stop working and to ascend.

In some possible implementation modes, the detection information of the robot cleaner includes obstacle information detected by the robot cleaner, the obstacle information includes a distance between the robot cleaner and an obstacle; and controlling the mopping component of the robot cleaner to stop working and/or to ascend if the detection information satisfies the non-mopping condition includes:

controlling the mopping component of the robot cleaner to ascend if the distance between the robot cleaner and the obstacle is less than or equal to a first preset distance.

In some possible implementation modes, the obstacle information further includes a size of the obstacle; and after controlling the mopping component of the robot cleaner to stop working and/or to ascend, the method further includes:

determining whether the size of the obstacle is less than or equal to a preset size; if so, controlling a sweeping component of the robot cleaner to descend and work for removing the obstacle; and if not, controlling the robot cleaner to bypass the obstacle.

In some possible implementation modes, after controlling the sweeping component of the robot cleaner to descend and work for removing the obstacle, the method further includes:

controlling the robot cleaner to turn around and return to a position at which the mopping component ascends; and controlling the sweeping component to ascend and controlling the mopping component to descend to continue mopping the region to be cleaned.

In some possible implementation modes, after controlling the robot cleaner bypasses the obstacle, the method further includes:

controlling the mopping component to descend to continue mopping the region to be cleaned.

In some possible implementation modes, the detection information of the robot cleaner includes current travel path information of the robot cleaner; and controlling the mopping component of the robot cleaner to stop working and/or to ascend if the detection information satisfies the non-mopping condition includes:

controlling the mopping component of the robot cleaner to ascend if the current travel path information indicates that the robot cleaner moves from one sub-region to be cleaned into another sub-region to be cleaned.

In some possible implementation modes, the mopping component includes a mopping roller brush, and the detection information of the robot cleaner includes floor medium information detected by the robot cleaner; and controlling the mopping component of the robot cleaner to stop working and/or to ascend if the detection information satisfies the non-mopping condition includes:

acquiring a current value of the mopping roller brush if the floor medium information does not match non-mopping object medium information; and controlling the mopping roller brush to ascend if the current value of the mopping roller brush is greater than or equal to a preset current value and a duration is greater than or equal to a first preset duration.

In some possible implementation modes, after controlling the mopping component of the robot cleaner to ascend, the method further includes:

acquiring a current value after the mopping roller brush ascends;

controlling an alarm apparatus of the robot cleaner to raise an alarm if the current value after the mopping roller brush ascends is greater than or equal to the preset current value and the duration is greater than or equal to a second preset duration; and if the current value after the mopping roller brush ascends is less than the preset current value, after a third preset duration, controlling the mopping roller brush to descend and acquiring a current value after the mopping roller brush descends; and if the current value after the mopping roller brush descends is greater than or equal to the preset current value, controlling the mopping roller brush to repeat said ascending and descending steps until the current value after the mopping roller brush descends is less than the preset current value.

In some possible implementation modes, the state information of the robot cleaner includes a current traveling mode of the robot cleaner; and controlling the mopping component of the robot cleaner to stop working and/or to ascend if the detection information satisfies the non-mopping condition includes:

controlling the mopping component to ascend if the traveling mode is a de-trapping mode.

In some possible implementation modes, after controlling the mopping component of the robot cleaner to ascend, the method further includes:

acquiring a real-time position of the robot cleaner if a de-trapping motion of the robot cleaner ends;

determining a distance between the real-time position and a position at which the mopping component ascends; and controlling the mopping component to descend if the distance between the real-time position and the position at which the mopping component ascends is greater than or equal to a second preset distance.

In a second aspect, embodiments of the present disclosure provide a control apparatus for a robot cleaner, the control apparatus including:

an acquiring module, configured to acquire detection information or state information of the robot cleaner in a case that the robot cleaner performs a mopping task; and a determining module, configured to control a mopping component of the robot cleaner to stop working and/or to ascend if the detection information or the state information satisfies a non-mopping condition.

In a third aspect, embodiments of the present disclosure provide a robot cleaner, including a walking component, a mopping component, and a controller, wherein the controller is configured to perform any method for controlling the robot cleaner according to the first aspect.

In a fourth aspect, embodiments of the present disclosure provide an electronic device, including a processor and a memory, wherein the memory is configured to store at least one executable instruction, and the executable instruction causes the processor to implement the steps of any method for controlling the robot cleaner according to the first aspect.

In a fifth aspect, embodiments of the present disclosure provide a computer-readable storage medium storing computer program instructions therein, wherein the computer program instructions, when invoked and executed by a processor, implement the steps of any method for controlling the robot cleaner according to the first aspect.

Embodiments of the present disclosure provide a robot cleaner and a method and an apparatus for controlling the robot cleaner, an electronic device, and a storage medium. According to the method, detection information or state information of the robot cleaner is firstly acquired; and the mopping component of the robot cleaner is controlled to stop working and/or to ascend if the detection information or the state information satisfies a non-mopping condition. Thus, the method can automatically stop a mopping mode in certain scenarios where the mopping mode is not appropriate, such that the working reliability of the robot cleaner can be improved.

The present disclosure has been illustrated by aforesaid embodiments, but it shall be understood that the aforesaid embodiments are merely exemplary and illustrative, and are not intended to limit the present disclosure to the scope of the embodiments as described. Further, it may be understood by those skilled in the art that the present disclosure is not limited to the aforesaid embodiments and that a greater variety of variations and modifications may be made in accordance with the teachings of the present disclosure, all of which fall within the protection scope as claimed by the present disclosure. The protection scope of the present disclosure is defined by the appended claims and their equivalent scope.

What is claimed is:

1. A method for controlling a robot cleaner, comprising:

acquiring detection information or state information of the robot cleaner in a case that the robot cleaner performs a mopping task; and controlling a mopping component of the robot cleaner to stop working or to ascend upwardly into the robot cleaner or to stop working and to ascend upwardly into the robot cleaner in response that the detection information or the state information satisfies a non-mopping condition;

wherein the detection information of the robot cleaner comprises obstacle information detected by the robot cleaner, the obstacle information further comprises a size of the obstacle; and the obstacle is a stain or a particle;

after controlling the mopping component of the robot cleaner to stop working or to ascend upwardly into the robot cleaner or to stop working and to ascend upwardly into the robot cleaner, the method further comprises:

determining whether the size of the obstacle is less than or equal to a preset size;

in response that the size of the obstacle is less than or equal to the preset size, controlling a sweeping component of the robot cleaner to descend to a surface of a region to be cleaned and work for removing the obstacle; and in response that the size of the obstacle is greater than the preset size, controlling the robot cleaner to bypass the obstacle;

wherein in a case that the sweeping component of the robot cleaner is in an ascending state, the sweeping component is not in contact with the surface of the region to be cleaned; and in a case that the sweeping component of the robot cleaner is in a descending state, the sweeping component is in contact with the surface of the region to be cleaned.

2. The method according to claim 1, wherein the detection information of the robot cleaner comprises a pitch angle of the robot cleaner relative to the surface of the region to be cleaned; and controlling the mopping component of the robot cleaner to stop working or to ascend upwardly into the robot cleaner or to stop working and to ascend upwardly into the robot cleaner in response that the detection information satisfies the non-mopping condition comprises:

in response that the pitch angle is not zero, controlling the mopping component to stop working or controlling the mopping component to stop working and to ascend upwardly into the robot cleaner.

3. The method according to claim 1, wherein the obstacle information comprises a distance between the robot cleaner and the obstacle; and controlling the mopping component of the robot cleaner to stop working or to ascend upwardly into the robot cleaner or to stop working and to ascend upwardly into the robot cleaner in response that the detection information satisfies the non-mopping condition comprises:

controlling the mopping component of the robot cleaner to ascend upwardly into the robot cleaner in response that the distance between the robot cleaner and the obstacle is less than or equal to a first preset distance.

4. The method according to claim 1, wherein after controlling the sweeping component of the robot cleaner to descend to the surface of the region to be cleaned and work for removing the obstacle, the method further comprises:

controlling the robot cleaner to return to a position at which the mopping component ascends upwardly into the robot cleaner; and controlling the sweeping component to ascend upwardly into the robot cleaner and controlling the mopping component to descend to the surface of the region to be cleaned, to mop the region to be cleaned.

5. The method according to claim 1, wherein after controlling the robot cleaner to bypass the obstacle, the method further comprises:

controlling the mopping component to descend to the surface of the region to be cleaned to mop the region to be cleaned.

6. The method according to claim 1, wherein the detection information of the robot cleaner comprises travel path information of the robot cleaner; and controlling the mopping component of the robot cleaner to stop working or to ascend upwardly into the robot cleaner or to stop working and to ascend upwardly into the robot cleaner in response that the detection information satisfies the non-mopping condition comprises:

controlling the mopping component of the robot cleaner to ascend upwardly into the robot cleaner in response that the travel path information indicates that the robot cleaner moves from a sub-region to be cleaned into another sub-region to be cleaned.

7. The method according to claim 1, wherein the mopping component comprises a mopping roller brush, and the detection information of the robot cleaner comprises floor medium information detected by the robot cleaner; and controlling the mopping component of the robot cleaner to stop working or to ascend upwardly into the robot cleaner or to stop working and to ascend upwardly into the robot cleaner in response that the detection information satisfies the non-mopping condition comprises:

acquiring a first electric current value of the mopping roller brush in response that the floor medium information does not match non-mopping object medium information; and controlling the mopping roller brush to ascend upwardly into the robot cleaner in response that the first electric current value is greater than or equal to a preset electric current value and a duration for which the first electric current value is greater than or equal to the preset electric current value is greater than or equal to a first preset duration.

8. The method according to claim 1, wherein the state information of the robot cleaner comprises a traveling mode of the robot cleaner; and controlling the mopping component of the robot cleaner to stop working or to ascend upwardly into the robot cleaner or to stop working and to ascend upwardly into the robot cleaner in response that the detection information satisfies the non-mopping condition comprises:

controlling the mopping component to ascend upwardly into the robot cleaner in response that the traveling mode is a de-trapping mode.

9. The method according to claim 7, wherein after controlling the mopping component of the robot cleaner to ascend upwardly into the robot cleaner, the method further comprises:

acquiring a second electric current value of the mopping roller brush after the mopping roller brush ascends upwardly into the robot cleaner;

controlling an alarm apparatus of the robot cleaner to raise an alarm in response that the second electric current value is greater than or equal to the preset electric current value and a duration for which the second electric current value is greater than or equal to the preset electric current value is greater than or equal to a second preset duration;

in response that the second electric current value is less than the preset electric current value, after a third preset duration, controlling the mopping roller brush to descend to the surface of the region to be cleaned and acquiring a third electric current value of the mopping roller brush after the mopping roller brush descends to the surface of the region to be cleaned; and in response that the third electric current value is greater than or equal to the preset electric current value, controlling the mopping roller brush to repeat said ascending and descending steps until the third electric current value is less than the preset electric current value.

10. The method according to claim 8, wherein after controlling the mopping component of the robot cleaner to ascend upwardly into the robot cleaner, the method further comprises:

acquiring a real-time position of the robot cleaner in response that a de-trapping motion of the robot cleaner ends;

determining a distance between the real-time position of the robot cleaner and a position of the robot cleaner at which the mopping component ascends upwardly into the robot cleaner; and controlling the mopping component to descend to the surface of the region to be cleaned in response that the distance is greater than or equal to a preset distance.

* * * * *